US009032947B2

(12) United States Patent
Bidigare et al.

(10) Patent No.: US 9,032,947 B2
(45) Date of Patent: May 19, 2015

(54) APPARATUS FOR MOUNTING A DAMPENER AND/OR STABILIZER TO AN ARCHERY BOW

(75) Inventors: Eric C. Bidigare, Flint, MI (US); Kerry A. Verran, Davison, MI (US)

(73) Assignee: K Tech Designs, L.L.C., Flint, MI (US)

( * ) Notice: Subject to any disclaimer, the term of this patent is extended or adjusted under 35 U.S.C. 154(b) by 54 days.

(21) Appl. No.: 13/604,972

(22) Filed: Sep. 6, 2012

(65) Prior Publication Data

US 2014/0060515 A1 Mar. 6, 2014

(51) Int. Cl.
*F41B 5/20* (2006.01)
*F41B 5/14* (2006.01)

(52) U.S. Cl.
CPC ..... *F41B 5/1426* (2013.01)

(58) Field of Classification Search
USPC ..... 124/86, 88, 89
See application file for complete search history.

(56) References Cited

U.S. PATENT DOCUMENTS 3,412,725 A * 11/1968 Hoyt, Jr. ..... 124/84
3,670,712 A 6/1972 Izuta
5,090,396 A 2/1992 Bickel et al.
5,611,325 A 3/1997 Kudlacek
5,657,741 A * 8/1997 Todd ..... 124/89
5,911,215 A * 6/1999 Fisher, Jr. ..... 124/86
D442,251 S 5/2001 Fitzgerald, Jr.
D446,278 S 8/2001 Fitzgerald, Jr.
D448,827 S 10/2001 Chipman
6,382,201 B1 5/2002 McPherson et al.
6,431,163 B1 8/2002 Chipman
6,675,793 B1 1/2004 Saunders
6,745,757 B2 6/2004 Sims
7,264,098 B2 9/2007 McPherson
7,278,216 B2 10/2007 Grace
7,318,430 B2 1/2008 Leven
7,610,686 B1 11/2009 Summers et al.
7,987,954 B2 8/2011 McPherson
8,225,778 B2 7/2012 Walk et al.
2010/0192932 A1 8/2010 Brewster
2010/0326415 A1 12/2010 Walk et al.
2011/0120440 A1 5/2011 Stokes
2012/0125310 A1 5/2012 Khoshnood

* cited by examiner

*Primary Examiner* — John Ricci
(74) *Attorney, Agent, or Firm* — Young Basile Hanlon & McFarlane P.C.

(57) ABSTRACT

The apparatus for mounting at least one dampener and/or stabilizer to an archery bow to absorb shock and vibration realized by an archer upon the release of the archery bow. The present invention provides an elongated support structure releasably connectable to the at least one dampener and/or stabilizer. A releasable fastener is connected to one end of the support structure, and the releasable fastener is releasably connectable to the archery bow such that the support structure is extendible in a cantilevered position relative to the archery bow.

20 Claims, 6 Drawing Sheets

APPARATUS FOR MOUNTING A DAMPENER AND/OR STABILIZER TO AN ARCHERY BOW

FIELD OF THE INVENTION

The present invention relates to the use of dampeners and/or stabilizers in an archery bow and, in particular, various structures for releasably mounting at least one dampener and/or stabilizer to an archery bow for effectively absorbing energy from the release of the archery bow.

BACKGROUND OF THE INVENTION

The archery bow is a simple mechanical device used to store energy derived from the archer during the drawing of the archery bow. When the archer releases the bow string or cable, the archery bow's energy is rapidly released. The greater portion of this energy is spent on launching the arrow, and much of the remaining energy is directed to the archery bow wherein the excess energy results in noise or is simply lost in the transfer process. Some of the energy directed back into the archery bow returns to its original undrawn state; however, much of this energy goes into excessive movement of various archery bow components, resulting in archery bow hand shock and system vibrations.

Because the trajectory of the arrow may be affected by any movement or vibration of the archery bow during the arrow's launch, it is desirable to reduce and/or eliminate such vibrations to the greatest extent possible by absorbing the energy in the archery bow. Thus, stabilizers and dampeners for archery bows have been designed and utilized in the archery field for many years. Such stabilizers and dampeners help absorb the shock and vibration that occur during the launch and release of an arrow from the archery bow.

Certain shock and vibration dampening devices have been created using lightweight materials, such as rubber and plastics. These devices have been mounted directly to the archery bows in an attempt to absorb such shock and vibration from the archery bow. However, the placement of these devices on the archery bow can be critical as to how well the dampening device operates. Many of these shock and dampening devices are mounted permanently to the archery bow, and therefore, the dampening device cannot be moved or changed. This is a disadvantage since an archer is unable to change the location or type of dampening device based on the performance characteristics of the dampening device.

Thus, it would be desirable to provide an apparatus that allowed for the effective and removable mounting of a dampener and/or stabilizer to an archery bow for absorbing energy from a released archery bow.

SUMMARY OF THE INVENTION

The present invention provides an apparatus for mounting at least one dampener and/or stabilizer to an archery bow. The apparatus of the present invention provides an elongated support structure releasably connectable to the at least one dampener and/or stabilizer. A releasable fastener is connected to one end of the support structure, and the fastener is releasably connectable to the archery bow such that the support structure is extendible in a cantilevered position relative to the archery bow.

The support structure of the present invention may have a substantially oval configuration having an outer frame with cross supports extending across the frame. The frame and the cross supports may be connectable to the at least one dampener and/or stabilizer. The cross supports may have a honeycomb configuration or a cross-hatch configuration.

The support structure of the present invention may also provide at least one substantially elongated cylindrical rod. A pair of end caps may be connected to the opposite ends of the at least one rod. The releasable fastener may be connected to one of the pair of end caps. The other of said pair of end caps may be connectable to the at least one dampener and/or stabilizer. The at least one dampener and/or stabilizer may be releasably connectable to the at least one rod and may be positioned between the pair of end caps. The at least one dampener and/or stabilizer may be spaced axially along the at least one rod and/or positioned at different angles with respect to the at least one rod.

The at least one rod may have at least two substantially elongate cylindrical rods extending parallel to one another. A casing for supporting each of the at least one dampener and/or stabilizer has an aperture extending through the casing for receiving one of the at least two rods. The casing also has at least one boss having an aperture extending through the boss for receiving a second of the at least one rod.

At least one bracket may be connected to and extend from the at least one rod. Each of the at least one bracket is releasably connectable to the at least one dampener and/or stabilizer. The at least one bracket extends radially outward from a longitudinal axis of the at least one rod, wherein the at least one dampener and/or stabilizer are connectable to a free end of the at least one bracket such that the at least one dampener and/or stabilizer are circumferentially spaced relative to the longitudinal axis of the at least one rod. A releasable fastener is connected to each of the at least one brackets for providing rotational and axial adjustment of the at least one bracket relative to the at least one rod. The at least one bracket may have at least two brackets axially and/or circumferentially spaced along the longitudinal axis of the at least one rod. The at least one brackets may have an arcuate configuration and a free end releasably connectable to the at least one dampener and/or stabilizer.

The at least one rod may have a metallic braided overlay connected to and extending over the outer surface of the at least one rod.

BRIEF DESCRIPTION OF THE DRAWINGS

The various features, advantages and other uses of the present apparatus will become more apparent by referring to the following detailed description and drawings in which.

DETAILED DESCRIPTION

Figure 1:
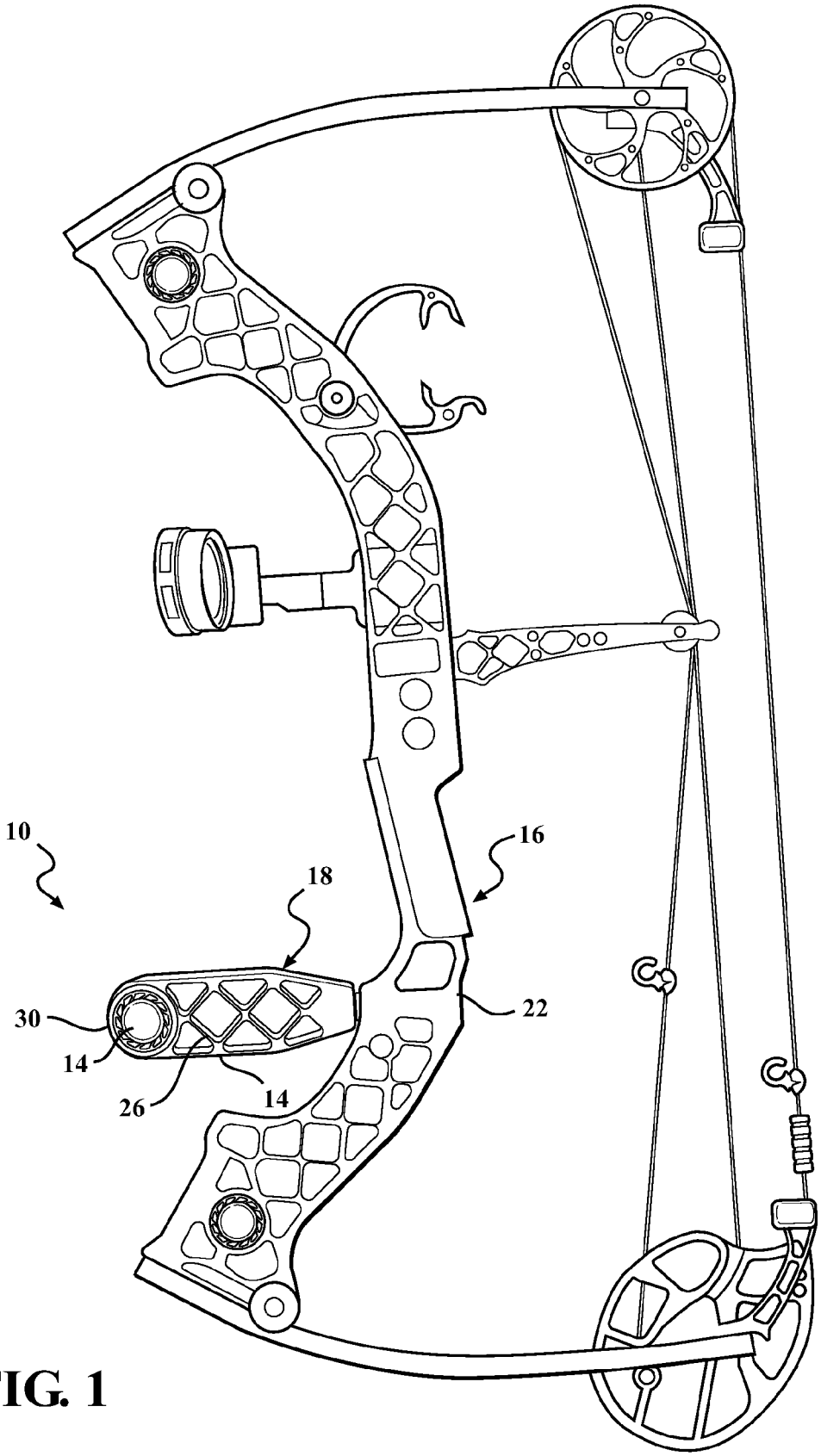
FIG. 1 is a front plan view of the apparatus for mounting the dampener and/or stabilizer to an archery bow of the present invention connected to an archery bow.

Referring to the drawings, the present invention will now be described in detail with reference to the disclosed embodiments.

As seen in FIGS. 1-6, the present invention provides an apparatus 10 for releasably mounting at least one dampener 12 and/or at least one stabilizer 14 to an archery bow 16. The archery bow 16 may include a conventional compound archery bow 16 as shown in FIG. 1; however, the apparatus 10 may be utilized in conjunction with other archery bows that may benefit from the absorption of shock and vibration as provided by the present invention. The apparatus 10 of the present invention provides an elongated support structure 18 for supporting at least one of the dampeners 12 and/or the stabilizers 14. The dampener 12 and the stabilizer 14 are conventional, such as those manufactured and sold by Matthews, Inc. of Sparta, Wis. Such conventional dampeners 12 and stabilizers 14 may be fabricated from a rubber spoked housing having an alloyed metal core centered in the rubber housing. The dampeners 12 and the stabilizers 14 are designed to absorb the residual energy in the archery bow 16. To effectively position the apparatus 10 on the archery bow 16, a fastener 20 is connected to one end of the elongated support structure 18 in order to releasably connect the apparatus 10 to the archery bow 16. A threaded aperture (not shown) may be provided in a body portion 22 of the archery bow 16, and the fastener 20 on the support structure 18 may be threaded into the threaded aperture provided in the body portion 22 of the archery bow 16. The apparatus 10 extends outward from the body portion 22 of the archery bow 16 in a cantilevered position relative to the archery bow 16. The position and design of the apparatus 10 allows an archer to remove and attach various embodiments of the apparatus 10 to the archery bow 16 while also assuring that the apparatus 10 does not affect the archer from operating the archery bow 16 and assuring that the position of the apparatus 10 does not affect the archer's vision when operating the archery bow 16. Through experimental use, it has been determined that the disclosed embodiments of the present invention provide an effective apparatus for absorbing shock and vibration from the release of the archery bow 16.

Figure 2:
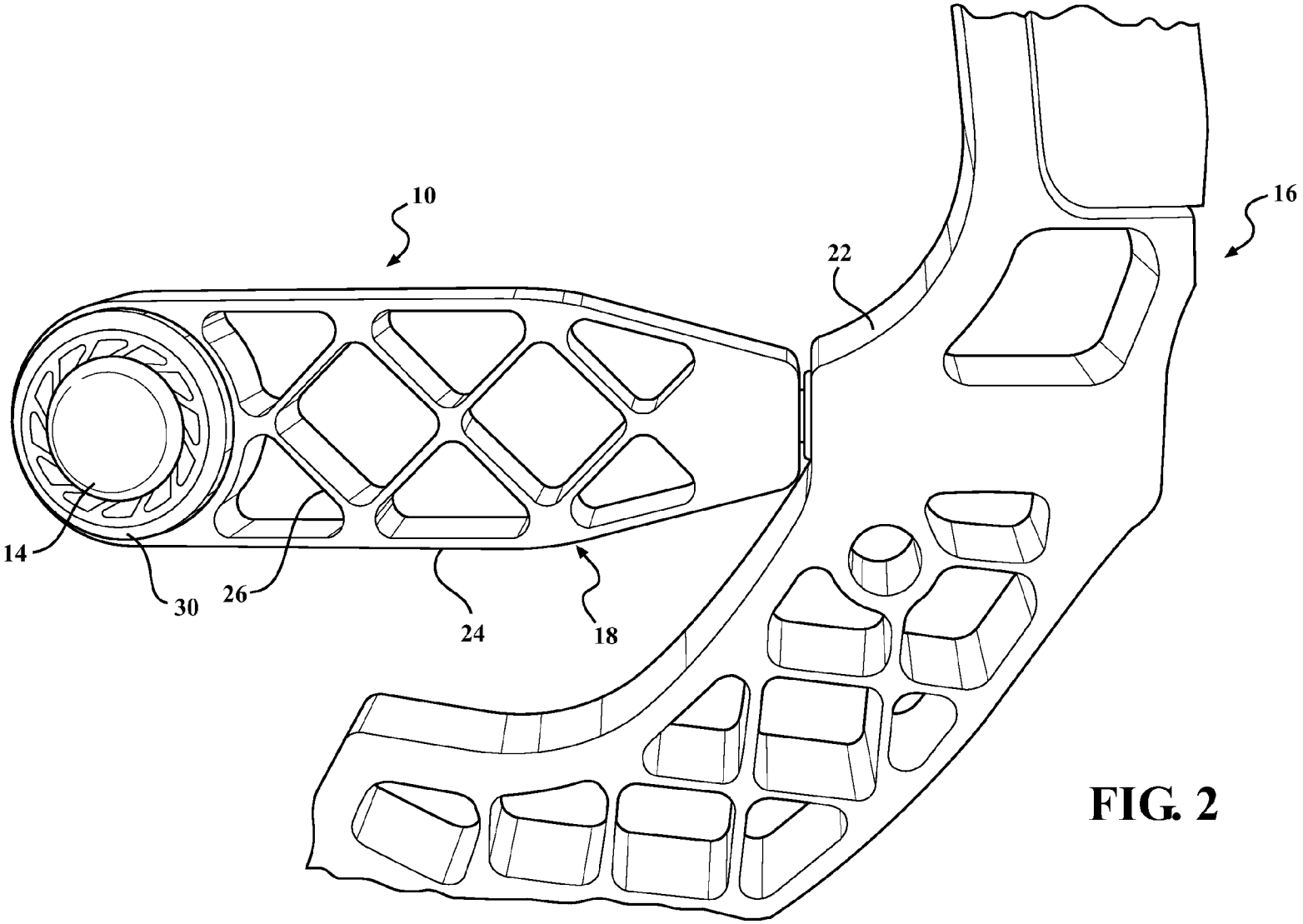
FIG. 2 is a schematic view of the present invention showing the support structure having cross supports with a honeycomb configuration.
Figure 3:
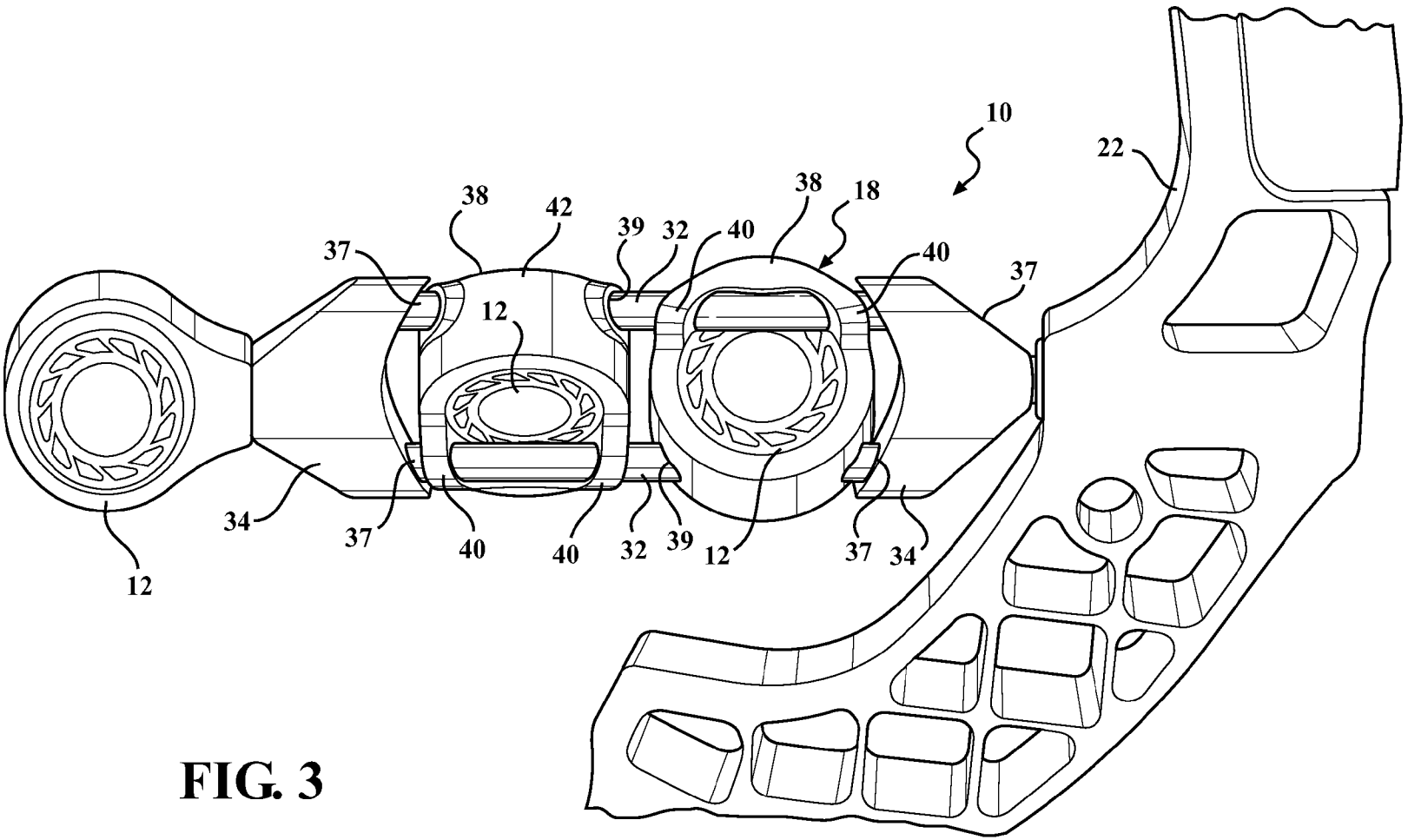
FIG. 3 is a schematic view of the present invention showing the support structure having a pair of rods.
Figure 4:
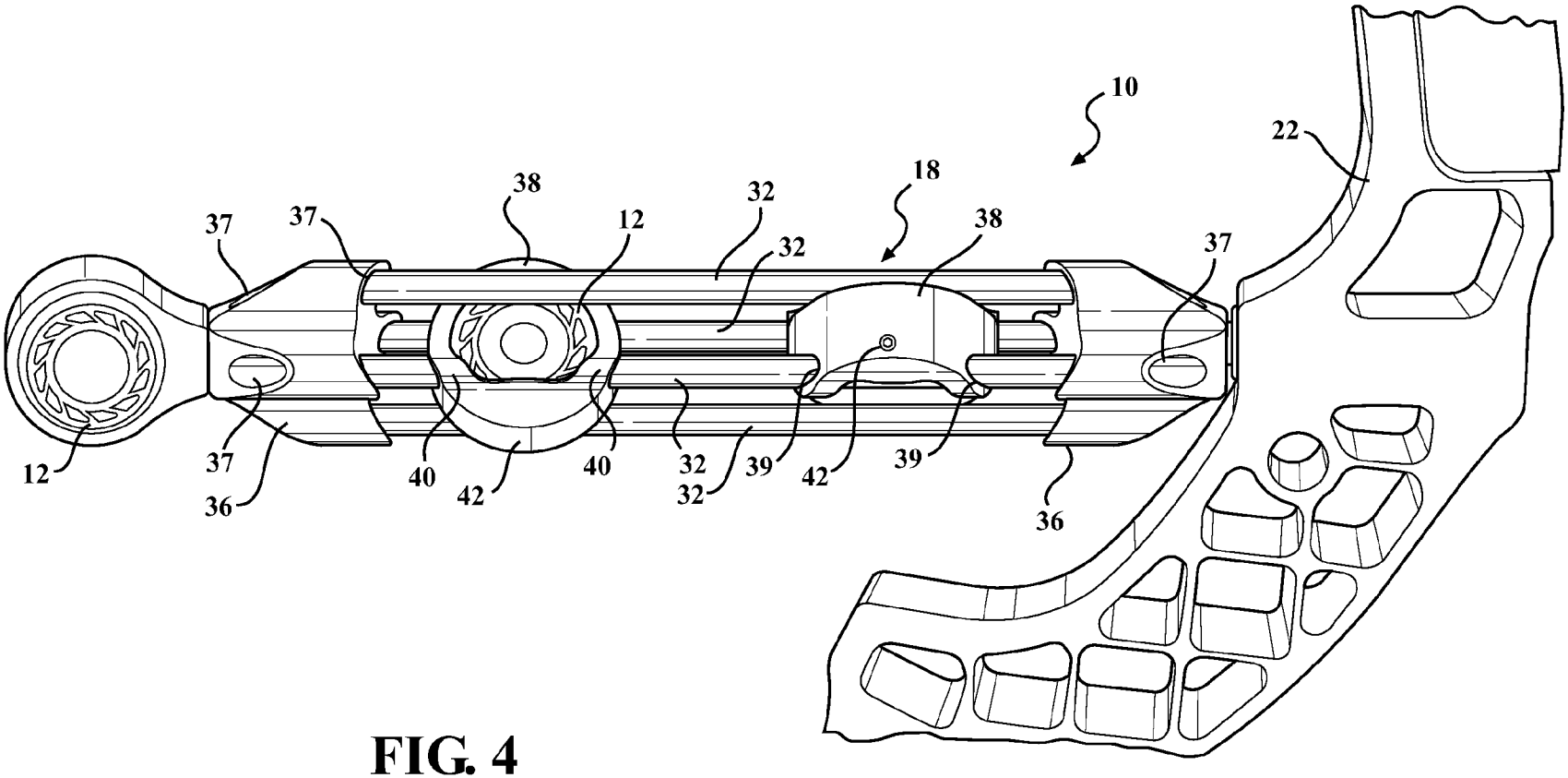
FIG. 4 is a schematic view of the present invention showing the support structure having four rods.

In order to mount the dampener 12 and/or the stabilizer 14 in a position that will effectively absorb residual energy from the archery bow 16, the apparatus 10 of the present invention provides several embodiments. As seen in FIGS. 1-2, a first embodiment of the present invention provides the support structure 18 of the apparatus 10 with a substantially oval configuration having an outer frame 24 that outlines the support structure 18. The support structure 18 also has various cross-members 26 that are defined by various voids or apertures that extend through the support structure 18. The cross-members 26 essentially extend between the outer frame 24 so as to support the support structure 18 in a rigid manner. The cross-members 26 and the outer frame 24 of the support structure 18 may also be utilized to form at least one substantially circular aperture 30 provided in the support structure 18. Each of the apertures 30 receives either the dampener 12 or the stabilizer 14. A snap fit is provided between the dampener 12 or the stabilizer 14 and the aperture 30 to releasably secure the dampener 12 and/or the stabilizer 14 in the apparatus 10. The snap fit provided between the aperture 30 and the dampener 12 or the stabilizer 14 may utilize any conventional friction fit. This allows an archer to customize the apparatus 10 by interchanging various dampeners 12 and stabilizers 14 having different absorption and dampening characteristics. The cross-members 26 of the support structure 18 may provide a honeycomb or cross-hatch configuration. The support structure 18 may be fabricated from a lightweight, high strength material, such as a plastic or other similar polymeric materials. The apparatus 10 of the present invention may utilize any number or combination of the dampeners 12 and/or the stabilizers 14.

In another embodiment, the support structure 18 of the apparatus 10 of the present invention may utilize a plurality of substantially cylindrical rods 32 connected to a pair of end caps 34, 36. The end caps 34 shown in FIG. 3 have a substantially U-shaped configuration for receiving a pair of the rods 32 in a substantially parallel configuration. The end caps 36 shown in FIG. 4 may have a substantially pyramidal configuration for receiving four of the rods 32 in a substantially parallel configuration. Each of the end caps 34, 36 provides apertures 37 for receiving the ends of the rods 32. A boss (not shown) may be formed within the apertures 37 of the end caps 34, 36 wherein a fastener (not shown) is inserted into each of the apertures 37. The fastener is threaded into the ends of the rods 32 to secure the rods 32 within the end caps 34, 36. One of the end caps 34, 36 has the fastener 20 connected thereto for releasably connecting the apparatus 10 to the archery bow 16. The fastener 20 has a threaded stud configuration connected to the end cap 34, 36. The end caps 34, 36 at the opposite end of the support structure 18 provide a threaded aperture for receiving a threaded fastener connected to the dampener 12 or the stabilizer 14. This allows the dampener 12 or the stabilizer 14 to be positioned on the open end of the support structure 18. At least one of the dampeners 12 and/or the stabilizers 14 may be connected to the rods 32 between the end caps 34, 36.

Specialized outer casings 38 may be provided for securing the dampener 12 and/or the stabilizer 14 to the rods 32. The casings 38 are substantially cylindrical and allow the dampener 12 or the stabilizer 14 to snap into and out of the casing 38. The casings 38 have an aperture 39 extending there through for receiving one of the rods 32. A pair of bosses 40 having an aperture extending there through are integrally formed on the casing 38 for allowing a second rod 32 to extend through the casing 38. A set screw 42 may be provided in the casing 38 wherein the set screw 42 is threaded against the rod 32 to secure the casing 38 in a set position relative to the rods 32. The casings 38 may be mounted at various angles and at a various longitudinal spacing with respect to the rods 32 to provide various energy-absorbing characteristics. The rods 32 may be fabricated from any high strength, lightweight material, such as various polymeric and metallic materials, and the end caps 34, 36 and the casings 38 may be formed of any high strength, lightweight material, such as polymeric materials.

Figure 5:
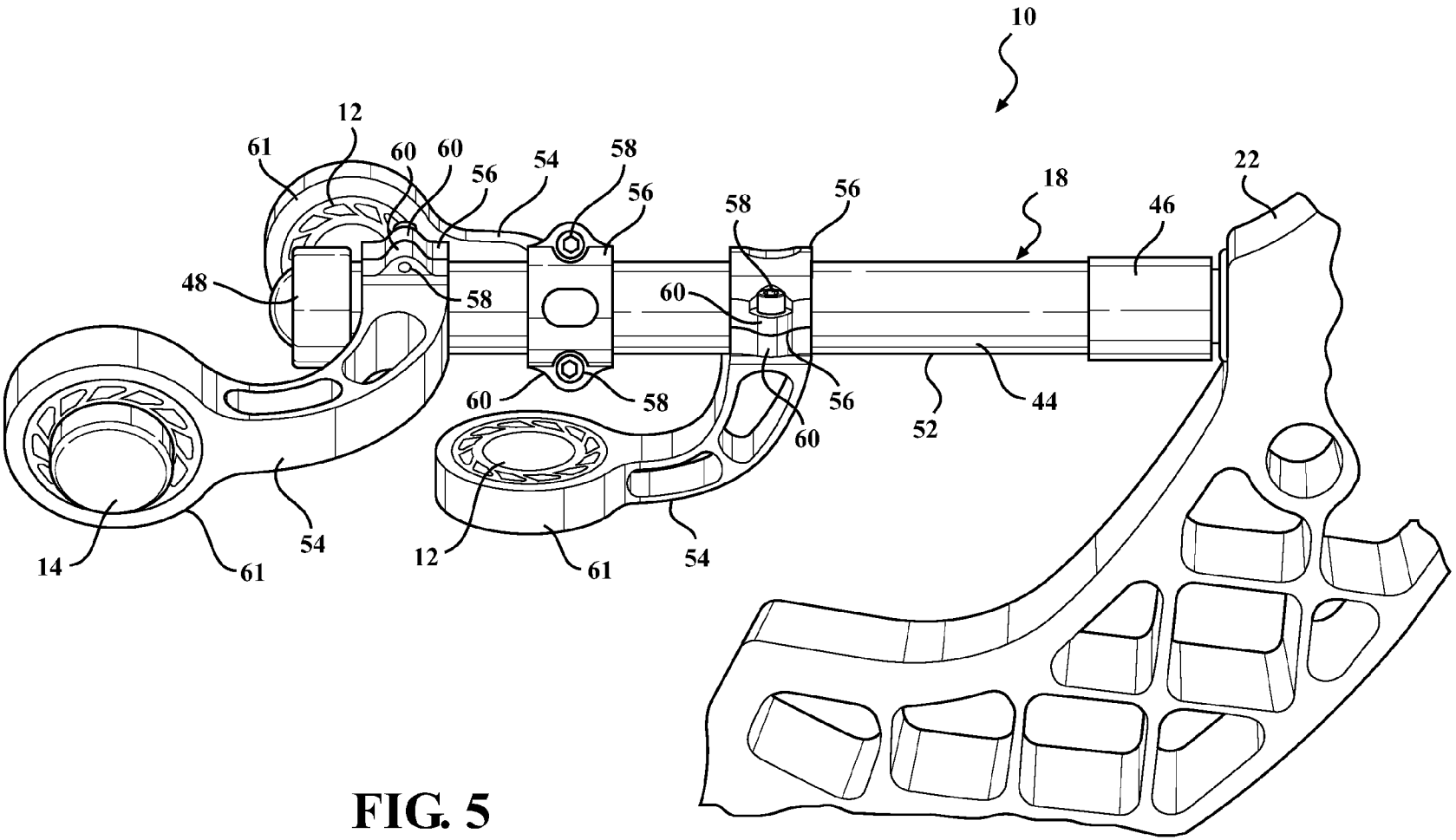
FIG. 5 is a perspective view of the present invention showing the support structure having a rod and brackets connected thereto.
Figure 6:
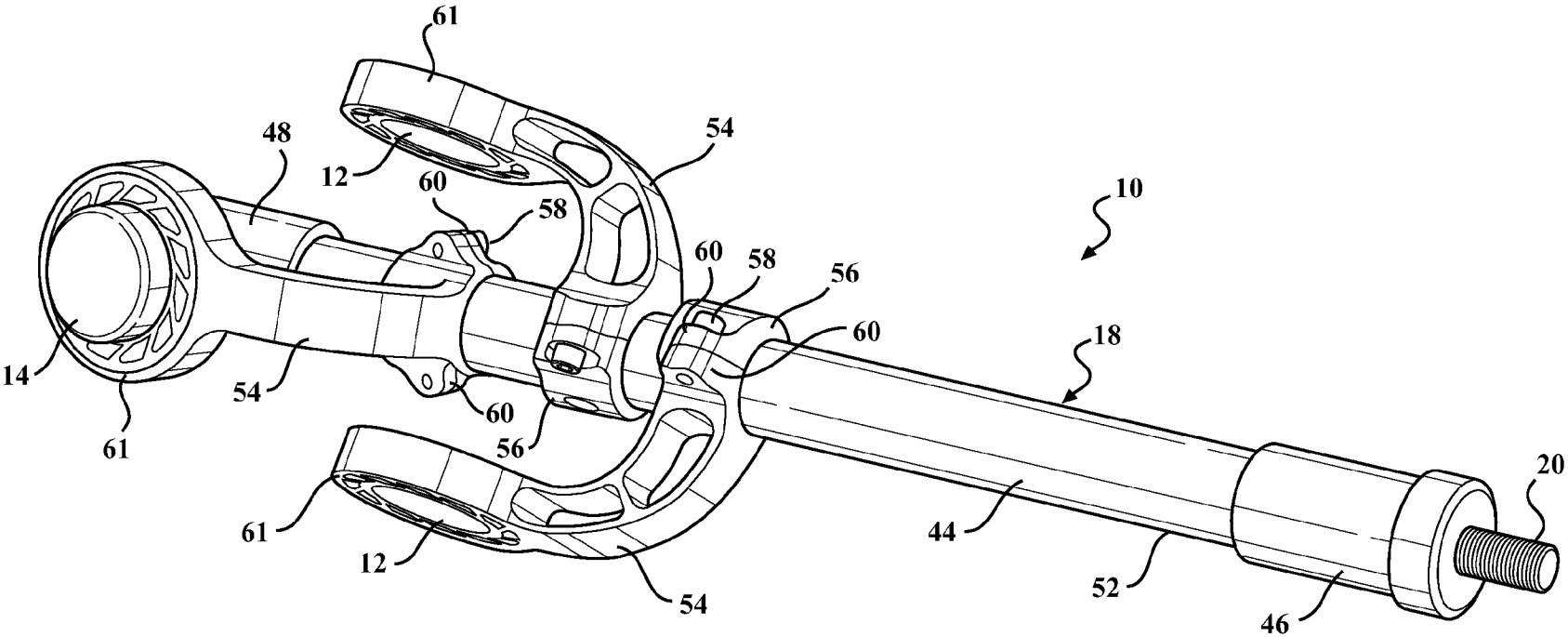
FIG. 6 is a perspective view of the present invention showing the support structure having a rod connected to an archery bow.

In yet another embodiment, the support structure 18 of the apparatus 10 of the present invention may provide an elongated cylindrical rod 44 having a pair of end caps 46, 48 connected to each end of the rod 44, as seen in FIG. 5-6. The end cap 46 has the fastener 20 connected to the end of the end cap 46 to allow the apparatus 10 to be removably connected to the threaded aperture in the archery bow 16. A braided metallic overlay 52 may be connected to the outer surface of the rod 44.

To secure at least one of the dampeners 12 and/or the stabilizers 14 to the apparatus 10, the support structure 18 of the apparatus 10 may provide arcuate shaped brackets 54 connected to the rod 44. One end of the brackets 54 has a substantially cylindrical configuration that is formed by a pair of semi-circular portions 56 that overlap and are connected to the rod 44. The pair of semi-circular portions 56 of the bracket 54 is secured to the rod 44 through the use of a pair of conventional fasteners 58 that extend through corresponding apertures provided in bosses 60 formed on each of the pair of semi-circular portions 56 of the bracket 54. By loosening and tightening the fasteners 58 on the bracket 54, the position of the bracket 54, and thus the position of the dampeners 12 and the stabilizers 14, can be adjusted along a longitudinal axis of the rod 44 and can be rotated with respect to the longitudinal axis of the rod 44. At the opposite, free end 61 of the bracket 54, an aperture is integrally formed in the bracket 54 for receiving the dampener 12 and/or the stabilizer 14. A snap fit or friction fit is provided in the aperture in the free end 61 of the bracket 54 for connecting the dampener 12 and/or the stabilizer 14 to the bracket 54. This also allows the archer to replace the dampener 12 and/or the stabilizer 14 with dampeners 12 and/or stabilizers 14 having the desired performance characteristics. The rod 44, the end caps 46, 48, and the brackets 54 may be fabricated from a lightweight, high strength material, such as a metallic or a polymeric material.

In use, the archer selects the apparatus 10 and threadably connects one of the embodiments of the apparatus 10 of the present invention to the archery bow 16. The archer may exchange the dampeners 12 and/or the stabilizers 14 with various other dampeners 12 and stabilizers 14 to provide various energy absorption characteristics in the archery bow 16. In addition, the archer may position the dampeners 12 and/or the stabilizers 14 in various positions, depending on the embodiment utilized in the present invention and depending on the desired characteristic of the apparatus 10.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An apparatus for mounting at least one dampener and/or stabilizer to an archery bow, comprising:

an elongated support structure releasably connectable to said at least one dampener and/or stabilizer having a longitudinal axis; and a releasable fastener connected to one end of said support structure having a longitudinal axis, and said fastener releasably connectable to said archery bow such that said support structure is extendible in a cantilevered position relative to said archery bow, wherein said longitudinal axis of one of said at least one dampener and/or stabilizer is substantially perpendicular to said longitudinal axis of said releaseable fastener, and wherein said elongated support structure is longer than said at least one dampener and/or stabilizer along said longitudinal axis.

2. The apparatus as stated in claim 1, said support structure further comprising:

at least one substantially elongate cylindrical rod connectable to said at least one dampener and/or stabilizer.

3. The apparatus as stated in claim 2, further comprising:

a pair of substantially similar end caps connected to opposite ends of said at least one substantially elongate cylindrical rod.

4. The apparatus as stated in claim 3, further comprising:

said releasable fastener connected to one of said pair of end caps.

5. The apparatus as stated in claim 3, further comprising:

one of said pair of end caps connectable to one of said at least one dampener and/or stabilizer.

6. The apparatus as stated in claim 2, further comprising:

said at least one dampener and/or stabilizer connectable to said at least one rod between said pair of end caps.

7. The apparatus as stated in claim 6, further comprising:

said at least one dampener and/or stabilizer axially spaced along said at least one rod.

8. The apparatus as stated in claim 6, comprising:

said at least one dampener and/or stabilizer positioned at different angles with respect to said at least one rod.

9. The apparatus as stated in claim 2, further comprising:

at least one bracket connected to and extending from said one rod, and each of said at least one bracket connectable to said at least one dampener and/or stabilizer.

10. The apparatus as stated in claim 9, further comprising:

said at least one bracket extending radially outward from said one rod, wherein said at least one dampener and/or stabilizer are connectable to a free end of said at least one bracket of said one rod.

11. The apparatus as stated in claim 10, further comprising:

said at least one bracket having an arcuate configuration.

12. The apparatus as stated in claim 10, further comprising:

at least two brackets circumferentially spaced with respect to said one rod.

13. The apparatus as stated in claim 9, further comprising:

a releasable fastener connected to said at least one bracket for providing rotational and axial adjustment of said at least one bracket relative to said one rod.

14. The apparatus as stated in claim 13, further comprising:

at least two brackets axially spaced along said longitudinal axis of said one rod.

15. The apparatus as stated in claim 2, further comprising:

a metallic braided overlay connected to and extending over an outer surface of said one rod.

16. The apparatus as stated in claim 2, wherein said at least one rod further comprises:

at least two substantially similar elongate cylindrical rods extending substantially parallel to one another.

17. The apparatus as stated in claim 16, further comprising:

a casing for supporting each of said at least one dampener and/or stabilizer, wherein said casing has an aperture extending through said casing for receiving one of said at least two rods and has at least one boss having an aperture extending through said boss for receiving a second of said at least two rods.

18. An apparatus for mounting at least one dampener and/or stabilizer to an archery bow comprising:

an elongated support structure releasably connectable to said at least one dampener and/or stabilizer;

a releaseable fastener connected to one end of said support structure, and said fastener releaseably connectable to said archery bow such that said support structure is extendible in a cantilevered position relative to said archery bow; and said support structure having a substantially oval configuration having an outer frame and cross supports extending across said frame, and said frame and said cross supports connectable to said at least one dampener and/or stabilizer.

19. The apparatus as stated in claim 18, further comprising:

said cross supports having a honeycomb configuration.

20. The apparatus as stated in claim 18, further comprising:

said cross supports having a cross-hatch configuration.

* * * * *